US009601851B2

(12) United States Patent
Jacoby et al.

(10) Patent No.: US 9,601,851 B2
(45) Date of Patent: Mar. 21, 2017

(54) LONGITUDINAL INSERTION OF CIRCUIT CARD ASSEMBLIES

(71) Applicant: Dell Products, LP, Round Rock, TX (US)

(72) Inventors: Robert B. Jacoby, Merrimack, NH (US); Praveen S. Lalgoudar, Bangalore (IN)

(73) Assignee: Dell Products, LP, Round Rock, TX (US)

( * ) Notice: Subject to any disclaimer, the term of this patent is extended or adjusted under 35 U.S.C. 154(b) by 95 days.

(21) Appl. No.: 14/601,632

(22) Filed: Jan. 21, 2015

(65) Prior Publication Data

US 2016/0211597 A1 Jul. 21, 2016

(51) Int. Cl.
*H01R 12/72* (2011.01)
*H01R 12/70* (2011.01)
*H01R 12/71* (2011.01)

(52) U.S. Cl.
CPC ..... *H01R 12/721* (2013.01); *H01R 12/7005* (2013.01); *H01R 12/7058* (2013.01); *H01R 12/716* (2013.01)

(58) Field of Classification Search
CPC ..... H01R 12/737
USPC ..... 439/637, 638, 64, 377
See application file for complete search history.

(56) References Cited

U.S. PATENT DOCUMENTS 3,576,515 A * 4/1971 Frantz ..... H01R 12/88 361/796
4,045,114 A * 8/1977 Dechelette ..... H01R 13/436 29/884
4,158,220 A * 6/1979 Yamamoto ..... H05K 7/1424 361/694
4,382,271 A * 5/1983 Villemont ..... H05K 7/1404 361/721
4,401,351 A * 8/1983 Record ..... H01R 23/68 361/688
4,421,372 A * 12/1983 Golden ..... H01R 12/82 439/260
4,498,717 A * 2/1985 Reimer ..... H05K 1/14 361/788

(Continued)

OTHER PUBLICATIONS

Sun Oracle, "Sun Server X3-2L (formerly Sun Fire X4270 M3)", Service Manual, Part No. E23396-15, Apr. 2014.

(Continued)

*Primary Examiner* — Neil Abrams
(74) *Attorney, Agent, or Firm* — Hamilton, Brook, Smith & Reynolds, P.C.

(57) ABSTRACT

A longitudinal insertion adapter includes an adapter socket assembly having a first end, a second end and a first set of electrical contacts. The adapter socket assembly is configured to accept a circuit card edge connector. At least one of the first and second ends has a void for accepting longitudinal insertion of the circuit card. The adapter further includes an edge connector assembly fixedly attached the adapter socket assembly. The edge connector assembly has a second set of electrical contacts arranged to couple electrically when the edge connector assembly is inserted into a fixed connector socket. The adapter socket assembly is fixedly attached to the edge connector assembly. Each contact of the first set of contacts is electrically coupled to a corresponding one of the second set of contacts.

16 Claims, 8 Drawing Sheets

(56) References Cited

U.S. PATENT DOCUMENTS

| | | | | | |
|---|---|---|---|---|---|
| 4,542,341 | A * | 9/1985 | Santomango | G01R 31/2642 | 324/750.05 |
| 4,715,820 | A * | 12/1987 | Andrews, Jr. | H01R 23/68 | 439/59 |
| 4,824,383 | A * | 4/1989 | Lemke | H01R 24/60 | 439/108 |
| 7,075,797 | B1 * | 7/2006 | Leonard | G06F 1/184 | 361/785 |
| 8,033,871 | B2 * | 10/2011 | Pocrass | H01R 23/10 | 439/344 |
| 8,308,490 | B2 * | 11/2012 | Molnar | H01R 12/88 | 439/61 |

OTHER PUBLICATIONS

PCI Express, "PCI Express Base Specification Revision 3.0", Nov. 10, 2010.

http://techpubs.sgi.com "Chapter 5 PCIc and Disk Add or Replace Procedures"; retrieved from Internet Jul. 21, 2015.

IBM Redbook Product Guide, "IBM BladeCenter PCI Express Gen 2 Expansion Blade and PCI Express Gen 2 Expansion Blade II". Mar. 1, 2013.

* cited by examiner

LONGITUDINAL INSERTION OF CIRCUIT CARD ASSEMBLIES

BACKGROUND OF THE INVENTION

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

PCIe (Peripheral Component Interconnect express) is an expansion bus standard for computers and other electronic systems. PCIe facilitates adding hardware to a computer (or other electronic) system by inserting an expansion circuit card into accommodating PCIe slots included in the computer system design.

The PCIe standard includes a "hot swap" or "hot plug" capability, which allows a PCIe compatible circuit card to be inserted or removed from the PCIe card slot, without shutting down or re-booting the computer system.

Hot swap is a very useful feature, but physical access constraints can limit its usefulness. A PCIe circuit card connector has a particular form factor, as shown the example of FIG. 1.

In general, the connector portion 100 of the circuit card includes a first set of contacts 102 and a second set of contacts 104, the sets separated by a space 106. The example shown in FIG. 1 is a PCIe 2.0×16 card connector format. Other configurations (e.g., PCIe 2.0×1 and PCIe 2.0×4) are also defined by the PCIe standard.

The circuit card connector fits into a socket (also referred to as a slot) mounted to, for example, a large printed circuit board (e.g., computer mother board). The example shown in FIG. 2 illustrates several sizes of PCIe sockets mounted on a circuit board.

An example of a PCIe circuit card 302 (such as is shown in FIG. 1) being inserted into a PCIe slot 304 on a motherboard 306 (such as is shown in FIG. 2) is illustrated in the example shown in FIG. 3.

As FIG. 3 depicts, the PCIe card and socket are designed for "vertical insertion," i.e., for the card to be inserted straight down into the socket.

The motherboard in the example shown in FIG. 3 typically resides within a housing or other enclosure. Once the motherboard (with PCIe card and socket) are fully enclosed (e.g., by attaching a cover plate to the enclosure), physical access to the PCIe circuit card may be difficult or impossible.

FIG. 4 shows an example of a closed housing 402, which has been withdrawn from a rack mount structure 404.

As FIG. 4 illustrates, once the enclosure is covered, and the enclosure is deployed back into a rack, access to the PCIe card is severely limited. Although side openings may be available for access to a PCIe card, the nature of the PCIe connector/socket arrangement only allows for vertical insertion of the card, i.e., directly down into a PCIe socket.

SUMMARY OF THE INVENTION

In one aspect, the invention is a longitudinal insertion adapter including an adapter socket assembly having a first end, a second end and a first set of electrical contacts. The adapter socket assembly is configured to accept a circuit card edge connector, at least one of the first and second ends having a void for accepting longitudinal insertion of the circuit card. The longitudinal insertion adapter further includes an edge connector assembly fixedly attached the adapter socket assembly. The edge connector assembly has a second set of electrical contacts arranged to couple electrically when the edge connector assembly is inserted into a fixed connector socket. The adapter socket assembly is fixedly attached to the edge connector assembly, and each contact of the first set of contacts being electrically coupled to a corresponding one of the second set of contacts.

In one embodiment, the adapter socket assembly and the edge connector assembly may be configured based on a PCIe standard. In another embodiment, a keying block specified by the PCIe standard may not be included within the adapter socket assembly. One or more end blocks specified by the PCIe standard may not be included within the adapter socket assembly.

The adapter socket assembly may be configured to facilitate movement of the first set of contacts away from a longitudinal axis of the adapter socket assembly prior to insertion of the circuit card, and facilitate movement of the first set of contacts back toward the longitudinal axis of the adapter socket after the circuit card is inserted into the adapter socket assembly. The motion may be angular, about a pivot point, or the motion may be linear so that the contacts from different sets remain substantially parallel to one another.

In one embodiment, the adapter socket assembly may further include an alignment stop for limiting the longitudinal insertion of the circuit card. The alignment stop may be configured to align each of a set of edge connector electrical contacts of the circuit card to a corresponding one of the first set of electrical connectors on the socket.

Some embodiments may further include a locking mechanism for securing the circuit card in the adapter once the circuit card has been completely inserted into the adapter. One embodiment may include a locking mechanism for securing the adapter to the fixed connector socket. In these embodiments, the locking mechanism may be selectively engaged or disengaged to lock or unlock the circuit card or the adapter.

In one embodiment, the edge connector assembly includes a keying element configured to properly position the edge connector into the fixed connector socket.

In one aspect, the invention is a longitudinal insertion adapter, including an upper portion having a socket for accepting a PCIe format external connector, and a lower portion having a PCIe format connector. The slot and the PCIe format connector may each have corresponding electrical contacts. The corresponding electrical contacts of the socket and the PCIe format connector electrically connected to one another.

In one embodiment, the socket includes a first side support and a second side support arranged substantially parallel to one another and separated by a distance d1. In another embodiment, the first side support and the second side support selectively convert from being separated by the distance d1 to being separated by a distance d2, where d2 may be greater than d1. The distances d1 and d2 may be angular distances or linear distances.

In one embodiment, the first side support and the second side support selected convert from being substantially parallel to being non-parallel. The first side support and the second side support may be configured to selectively clamp a PCIe connector between them.

One embodiment may further include an alignment stop for limiting the longitudinal insertion of the circuit card. The alignment stop may be configured to align each of a set of edge connector electrical contacts of a circuit card to a corresponding one of the first set of electrical connectors on the socket.

In another aspect, the invention is a longitudinal insertion adapter, including an adapter socket assembly having a first end, a second end and a first set of electrical contacts. The adapter socket assembly may be configure to accept a circuit card edge connector. At least one of the first and second ends may include a void for accepting longitudinal insertion of the circuit card. The longitudinal insertion adapter may further include a connector assembly fixedly attached the adapter socket assembly. The connector assembly may have a second set of electrical contacts arranged to couple electrically when the edge connector assembly is attached to a printed circuit board. The adapter socket assembly may be fixedly attached to the edge connector assembly, and each contact of the first set of contacts may be electrically coupled to a corresponding one of the second set of contacts.

In one embodiment, the adapter socket assembly is configured to facilitate movement of the first set of contacts away from a longitudinal axis of the adapter socket assembly prior to insertion of the circuit card, and movement of the first set of contacts back toward the longitudinal axis of the adapter socket after the circuit card is inserted into the adapter socket assembly. The adapter socket assembly and the edge connector assembly may be configured based on a PCIe standard.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

In one aspect, the invention is an adapter that facilitates "longitudinal insertion" of a PCIe circuit card, i.e., insertion in the direction of the longitudinal axis of the socket.

Figure 5:
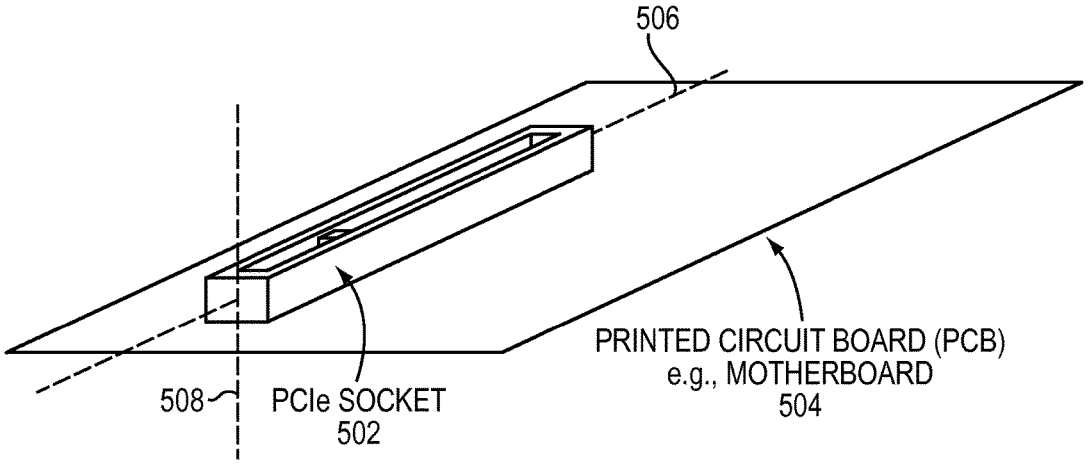
FIG. 5 illustrates a PCIe socket mounted to a motherboard.

FIG. 5 illustrates an example PCIe socket 502, mounted to a motherboard 504 (also referred to herein as a printed circuit board). Example longitudinal axis 506 and vertical axis 508 are shown for reference. Mounting of such a PCIe socket 502 is generally considered permanent, since although the connector can be removed, doing so can be a significant task requiring difficult soldering operations that could damage or reduce the reliability of the mother board to which the PCIe socket is attached.

Figure 6:
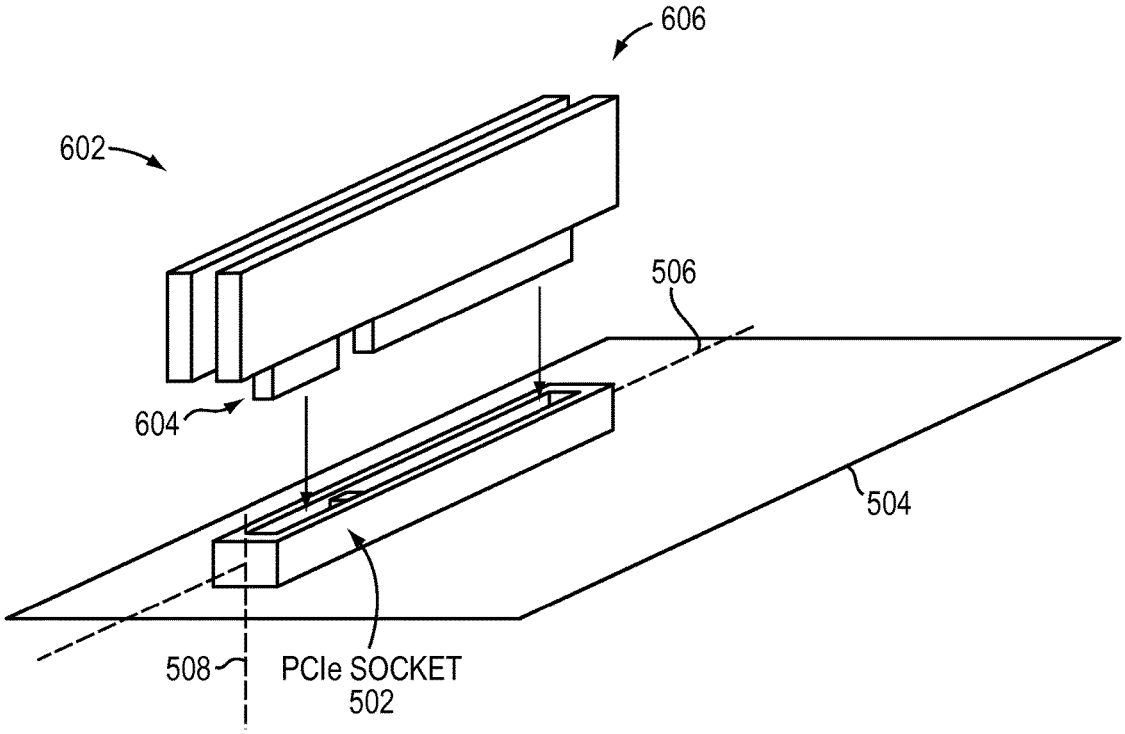
FIG. 6 shows a Longitudinal Insertion Adapter (LIA), according to one embodiment of the invention.

FIG. 6 shows a Longitudinal Insertion Adapter 602 (referred to herein as LIA), according to one embodiment of the invention, being deployed into the PCIe socket 502. The fact that the LIA 602 can be inserted into the PCIe socket 502 means that the PCIe socket 502 does not need to be removed to provide the capability of longitudinal insertion.

In one embodiment, the lower portion LIA 602 has the same form factor PCIe connector as a card that would ordinarily be inserted into the PCIe socket 502. To the PCIe socket, some embodiments of the LIA 602 may be indistinguishable from a circuit card with an ordinary PCIe connector.

The LIA 602 has a lower portion 604 that includes features of a PCIe connector and an upper portion 606 that is a modified version of a PCIe socket. Conductors within the LIA 602 electrically connect contacts on the LIA PCIe connector (i.e., the lower portion 604) to corresponding contacts in the PCIe socket of the LIA (i.e., the upper portion 606).

Figure 1:
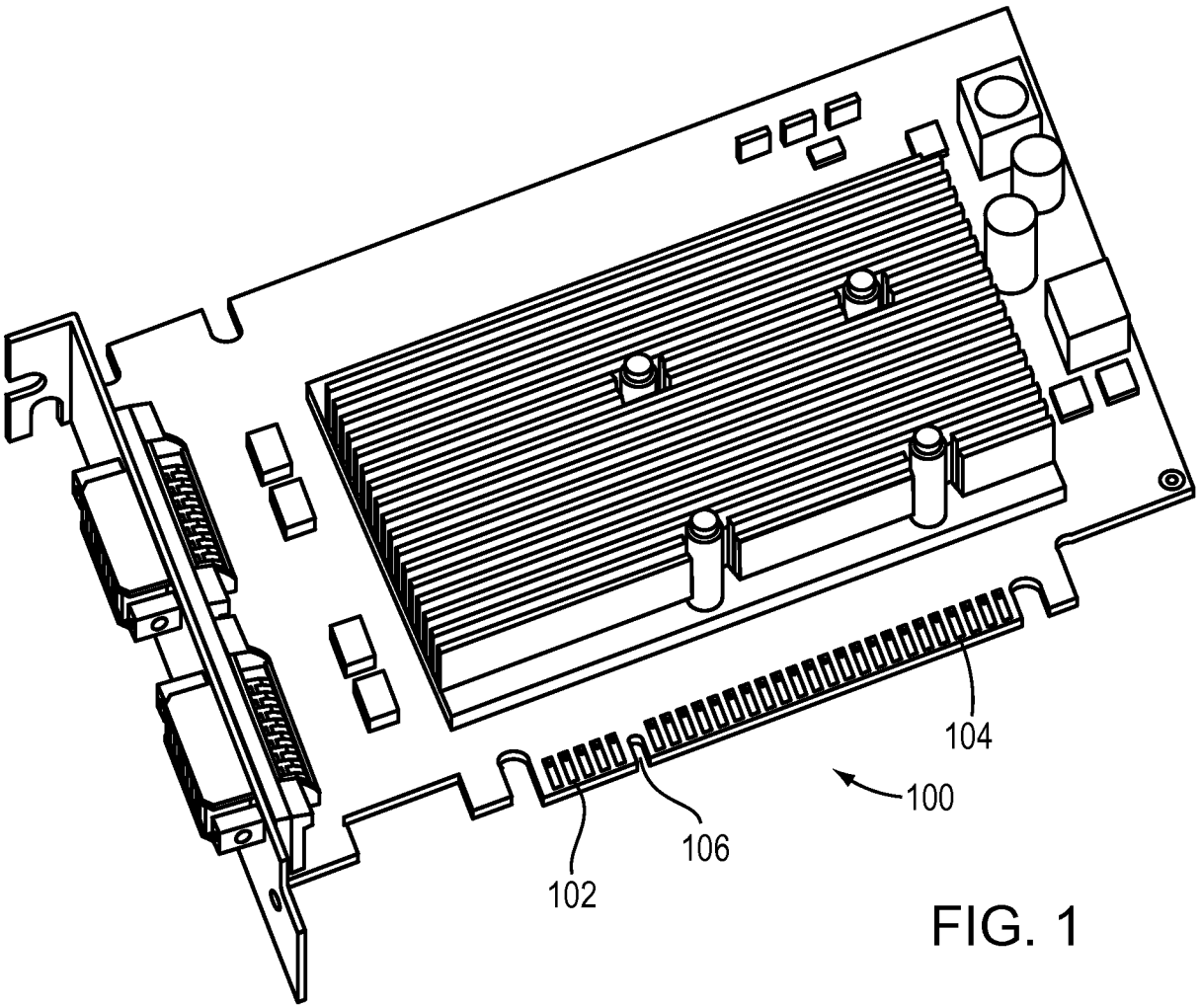
FIG. 1 shows an example of a circuit with a PCIe connector.
Figure 2:
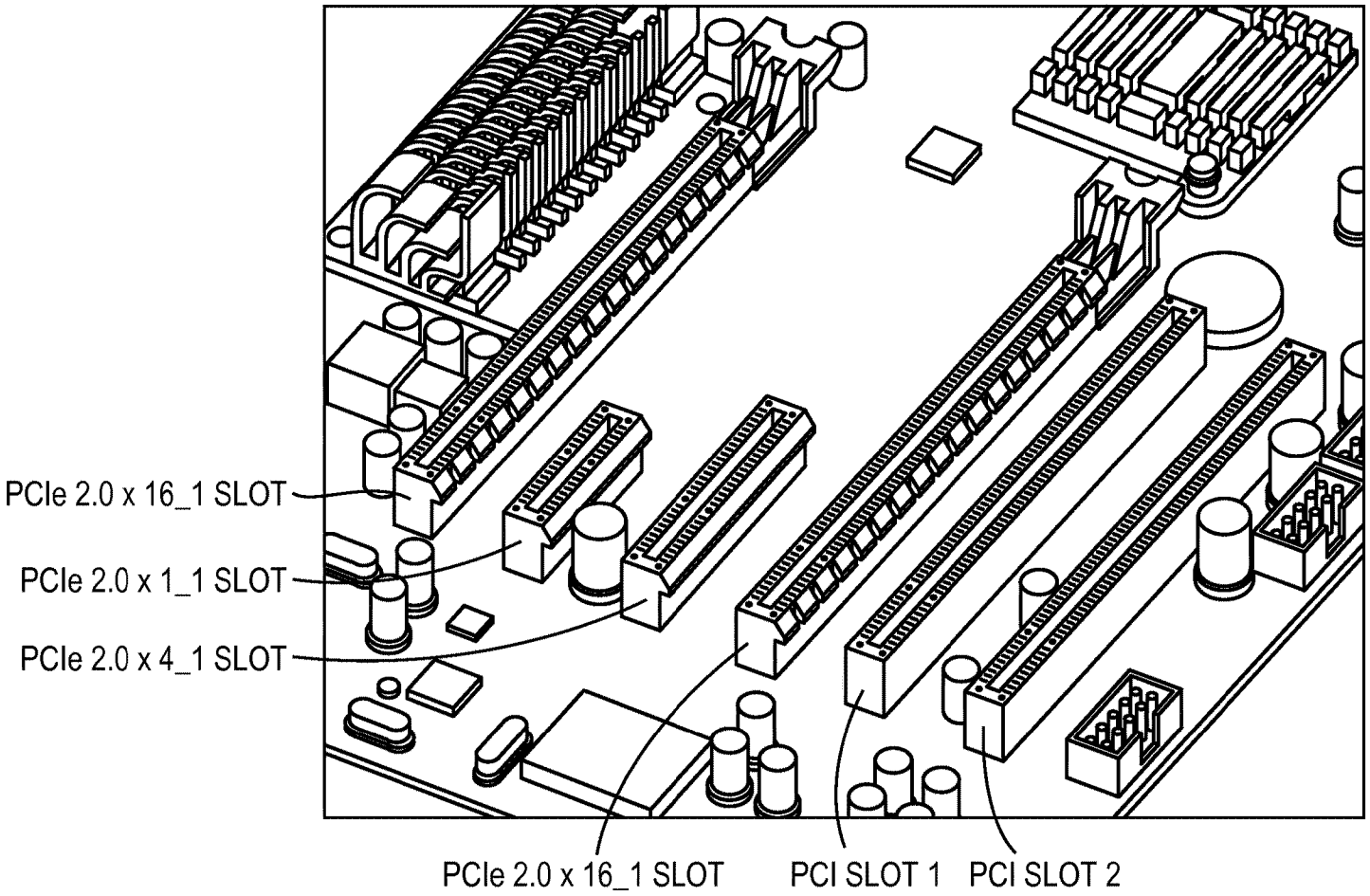
FIG. 2 shows examples of PCIe sockets mounted to a motherboard.
Figure 3:
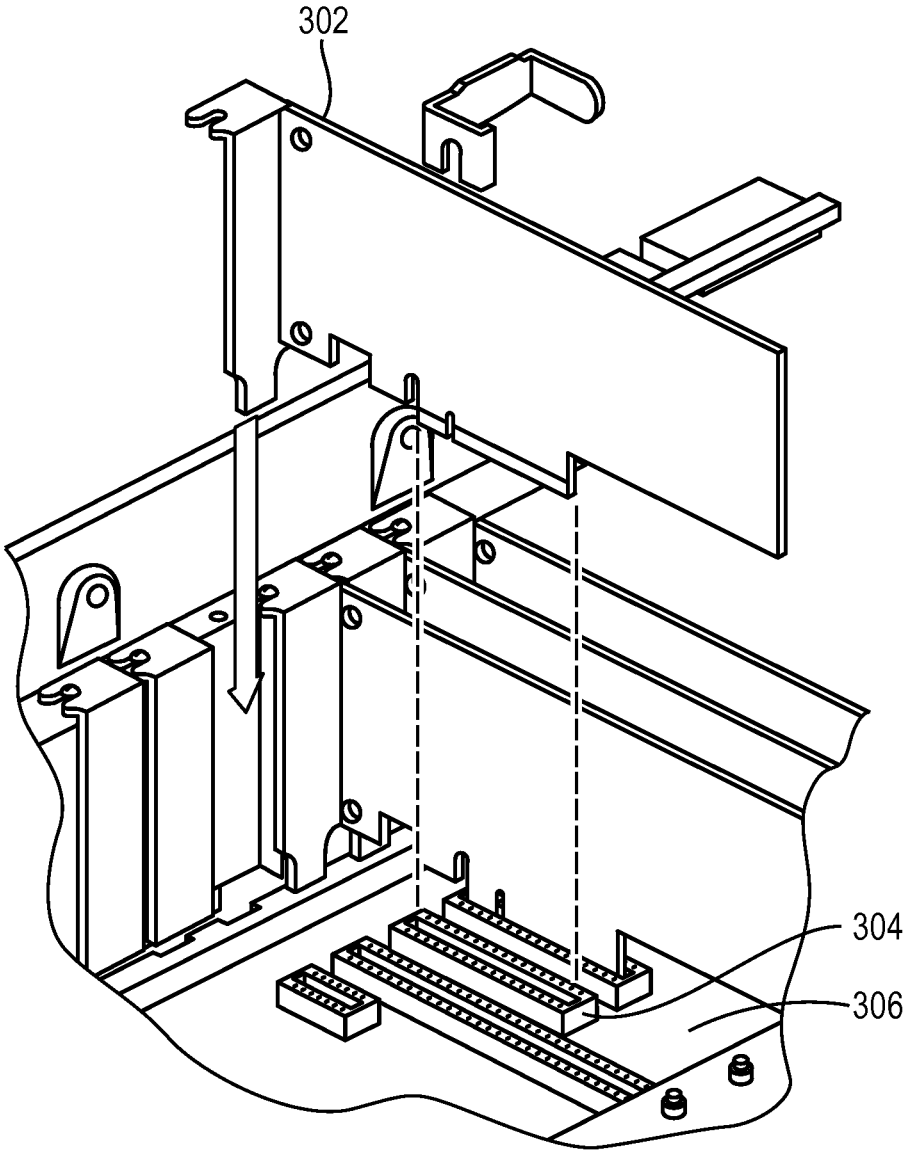
FIG. 3 shows PCIe card and socket are designed for vertical insertion.
Figure 4:
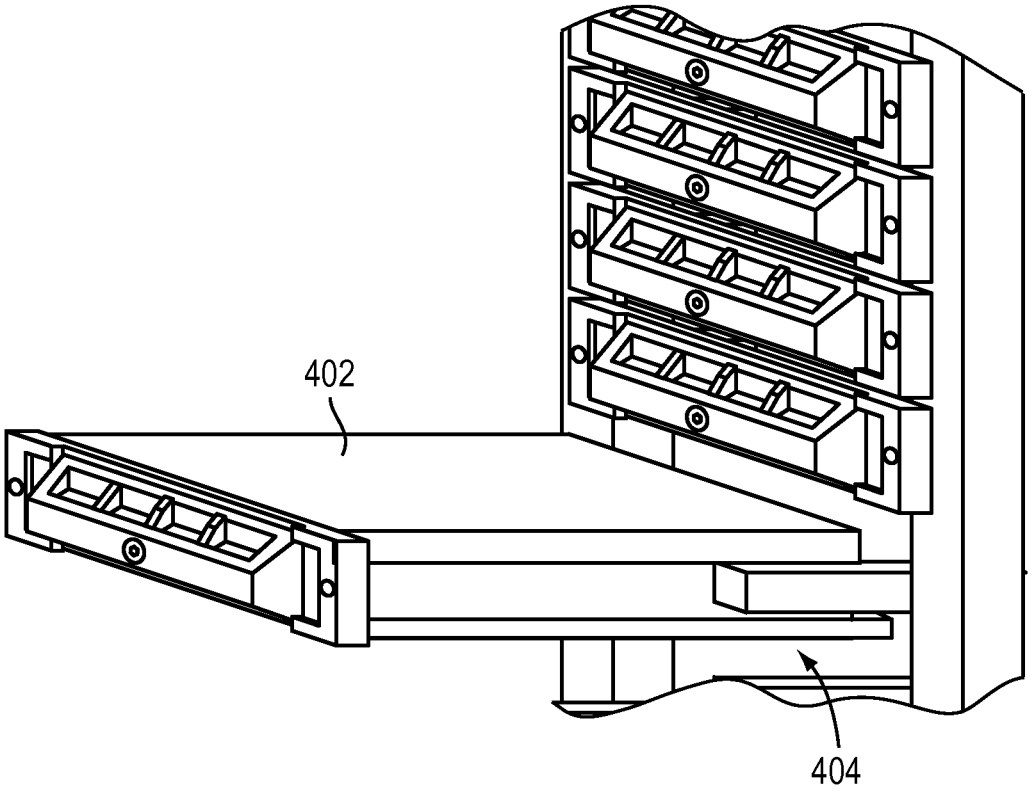
FIG. 4 shows a covered enclosure, deployed back into a rack.

As mentioned herein with respect to FIG. 1, a PCIe connector is characterized by a first set of contacts and a second set of contacts, separated by a gap or a space. A standard PCIe socket further includes a keying block (identified by reference number 608 in FIG. 6) that fits into the space between the sets of contacts when the PCIe connector is inserted into the PCIe socket.

In one embodiment, the LIA 602 is modified with respect to a standard PCIe socket by eliminating the keying block. The presence of a keying block would impede longitudinal insertion of a PCIe connector, so its removal allows free longitudinal motion of a circuit card connector along the upper portion of the LIA 602.

Figure 7:
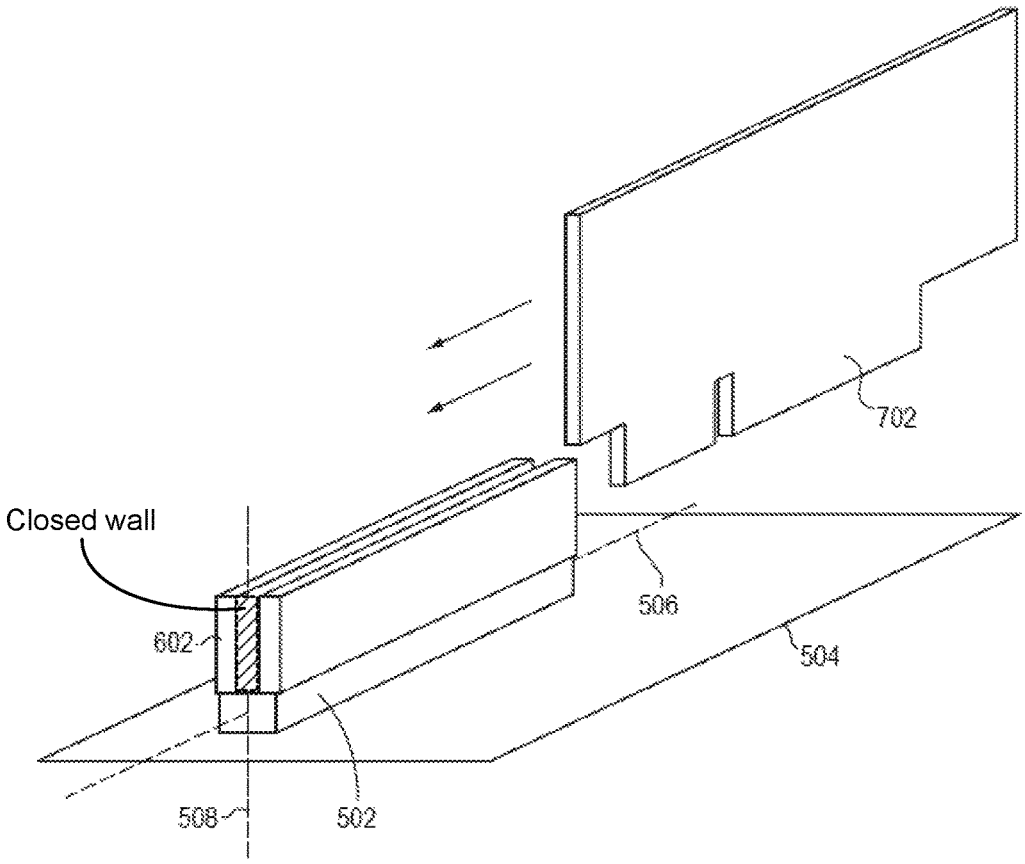
FIG. 7 illustrates an example PCIe circuit board being longitudinally inserted into a longitudinal insertion adapter.

FIG. 7 illustrates an example PCIe circuit board 702 being longitudinally inserted into the longitudinal insertion adapter 602, which has been inserted into the PCIe socket, according to one aspect of the invention.

Figure 8B:
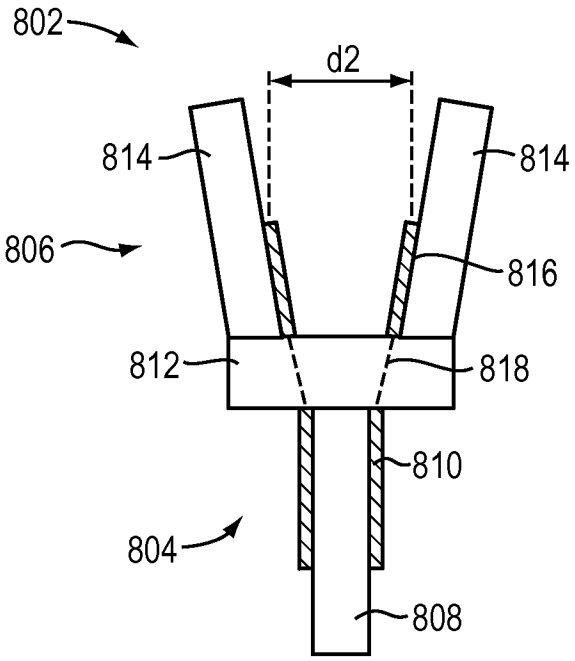
FIG. 8B shows the clamshell LIA in the open position.
Figure 8A:
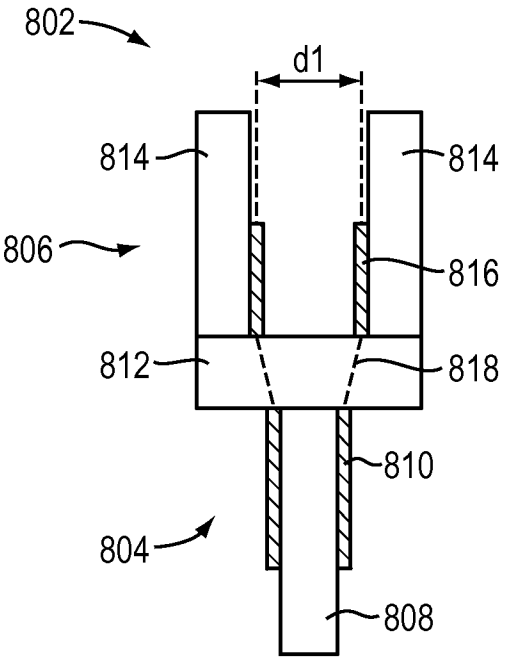
FIG. 8A shows a clamshell LIA in the closed position.

An embodiment of the upper portion of the LIA 602 may open or otherwise separate to create more room for a PCIe connector to move longitudinal along the LIA 602. FIGS. 8A and 8B illustrate an end view of "clamshell" style LIA architecture for providing such additional room. The clamshell LIA embodiment is only one way of providing an LIA that may be temporarily modified to provide additional room for inserting a PCIe connector.

FIG. 8A shows a clamshell LIA 802 in the closed position, including a lower portion 804 and an upper portion 806. The lower portion 804 includes a connector post 808 that supports connector conductors 810. The connector post 808 is attached to base 812. The upper portion 806 includes side supports 814 that together with the base 812 form the PCIe slot portion of the clamshell LIA 802. Each of the side supports 814 support slot contacts 816, which are electrically coupled to the connector conductors 810 through electrical conductors 818.

FIG. 8B illustrates the clamshell LIA 802 in the open position, where the side supports 814 tilt away from one another to create space between the contacts 816. In one embodiment, the clamshell LIA 802 includes a mechanism that allows a user to manually open the side supports 814, and to close them again once the PCIe circuit card has been installed. In another embodiment, the clamshell LIA 802 includes a mechanism that closes the supports 814 upon complete insertion of the PCIe circuit card. For example, the circuit card may engage a trip lever upon complete insertion, which in turn drives the supports 814 closed to engage the PCIe connector of the circuit card.

In one embodiment, at least one of the ends of the LIA 602 is open, in contrast with the solid "end caps" of a standard PCIe connector. The open end wall allows a PCIe circuit card to longitudinally enter the LIA 602. In some embodiments, one of the end walls may be left closed. The closed wall may be used as a stop for controlling the extent of the insertion of the PCIe circuit card, for alignment purposes, or both.

For some embodiments, the lower portion of the adapter is configured to connect directly to a printed circuit board, rather than interface through a PCIe connector as described in connection with FIGS. 1-8. The electrical connections to the printed circuit board may be via surface mount technology, through-hole technology, or other electrical connections known in the art.

For purposes of this disclosure, an information handling system may include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, an information handling system may be a personal computer (e.g., desktop or laptop), tablet computer, mobile device (e.g., personal digital assistant (PDA) or smart phone), server (e.g., blade server or rack server), a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, touchscreen and/or a video display. The information handling system may also include one or more buses operable to transmit communications between the various hardware components.

While this invention has been particularly shown and described with references to example embodiments thereof, it will be understood by those skilled in the art that various changes in form and details may be made therein without departing from the scope of the invention encompassed by the appended claims.

What is claimed is:

1. A longitudinal insertion adapter, comprising:

an adapter socket assembly having a first end, a second end and a first set of electrical contacts, the adapter socket assembly configured to accept a circuit card edge connector defining a first plane, at least one of the first and second ends having a void for accepting longitudinal insertion of the circuit card; and an edge connector assembly fixedly attached the adapter socket assembly, the edge connector assembly defining a second plane and having a second set of electrical contacts arranged to couple electrically when the edge connector assembly is inserted into a fixed connector socket, each contact of the first set of contacts being electrically coupled to a corresponding one of the second set of contacts;

the first plane and the second plane being substantially parallel, the adapter socket assembly being configured to facilitate movement of the first set of contacts away from a longitudinal axis of the adapter socket assembly prior to insertion of the circuit card, and movement of the first set of contacts back toward the longitudinal axis of the adapter socket after the circuit card is inserted into the adapter socket assembly.

2. The adapter of claim 1, wherein adapter socket assembly and the edge connector assembly are configured based on a PCIe standard.

3. The adapter of claim 2, wherein a keying block specified by the PCIe standard is not included within the adapter socket assembly.

4. The adapter of claim 2, wherein one or more end blocks specified by the PCIe standard is not included within the adapter socket assembly.

5. The adapter of claim 1, further including a stop for limiting the longitudinal insertion of the circuit card.

6. The adapter of claim 5, wherein the stop is configured to align each of a set of edge connector electrical contacts of the circuit card to a corresponding one of the first set of electrical connectors on the adapter socket.

7. The adapter of claim 1, further including a support for securing the circuit card in the adapter once the circuit card has been completely inserted into the adapter.

8. The adapter of claim 1, further including a support for securing the adapter to the fixed connector socket.

9. The adapter of claim 1, wherein the edge connector assembly includes a keying element configured to properly position the edge connector into the fixed connector socket.

10. A longitudinal insertion adapter, comprising:

an upper portion having a socket for accepting a PCIe format external connector of a circuit card defining a first plane;

a lower portion having a PCIe format connector defining a second plane;

the socket and the PCIe format connector each having corresponding electrical contacts, the corresponding electrical contacts of the socket and the PCIe format connector electrically connected to one another;

the first plane and the second plane being substantially parallel, the socket includes a first side support and a second side support arranged substantially parallel to one another and separated by a distance d1, the first side support and the second side support selectively convert from being separated by the distance d1 to being separated by a distance d2.

11. The adapter according to claim 10, wherein the first side support and the second side support selected convert from being substantially parallel to being non-parallel.

12. The adapter according to claim 10, wherein the first side support and the second side support are configured to selectively clamp a PCIe connector between them.

13. The adapter of claim 10, further including a stop for limiting the longitudinal insertion of the circuit card.

14. The adapter of claim 13, wherein the stop is configured to align each of a set of edge connector electrical contacts of a circuit card to a corresponding one of the first set of electrical connectors on the socket.

15. A longitudinal insertion adapter, comprising:

an adapter socket assembly having a first end, a second end and a first set of electrical contacts, the adapter socket assembly configured to accept a circuit card edge connector defining a first plane, at least one of the first and second ends having a void for accepting longitudinal insertion of the circuit card; and an edge connector assembly fixedly attached the adapter socket assembly, the edge connector assembly defining a second plane and having a second set of electrical contacts arranged to couple electrically to a printed circuit board when the edge connector assembly is attached to the printed circuit board, each contact of the first set of electrical contacts being electrically coupled to a corresponding one of the second set of electrical contacts;

the first plane and the second plane being substantially parallel, the adapter socket assembly is configured to facilitate movement of the first set of contacts away from a longitudinal axis of the adapter socket assembly prior to insertion of the circuit card, and movement of the first set of contacts back toward the longitudinal axis of the adapter socket after the circuit card is inserted into the adapter socket assembly.

16. The longitudinal insertion adapter of claim 15, wherein adapter socket assembly and the edge connector assembly are configured based on a PCIe standard.

* * * * *